US012416474B2

(12) United States Patent
Chrobak et al.

(10) Patent No.: US 12,416,474 B2
(45) Date of Patent: Sep. 16, 2025

(54) GUIDANCE KIT WITH VARIABLE ANGULAR OFFSET FOR UNDETECTED GROUND SUPPRESSION AND METHODS THEREOF

(71) Applicant: BAE Systems Information and Electronic Systems Integration Inc., Nashua, NH (US)

(72) Inventors: Matthew F. Chrobak, Groton, MA (US); Jason H. Batchelder, Lyndeborough, NH (US); Samantha Kirsh, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 553 days.

(21) Appl. No.: 17/733,231

(22) Filed: Apr. 29, 2022

(65) Prior Publication Data

US 2023/0349670 A1 Nov. 2, 2023

(51) Int. Cl.
*F41G 7/36* (2006.01)

(52) U.S. Cl.
CPC ..... *F41G 7/36* (2013.01)

(58) Field of Classification Search
CPC ..... F41G 7/36
See application file for complete search history.

(56) References Cited

U.S. PATENT DOCUMENTS 3,951,359 A * 4/1976 Willhite ..... F41G 7/24 244/3.14
4,492,166 A 1/1985 Purcell
5,685,504 A * 11/1997 Schneider ..... F41G 7/303 244/3.11
6,488,231 B1 12/2002 Schoffl
10,323,907 B1 * 6/2019 Wright ..... F41G 7/36
11,230,375 B1 * 1/2022 Hoffberg ..... B64C 21/00
12,044,506 B1 * 7/2024 Zemany ..... F41G 7/2246
2007/0295855 A1 * 12/2007 Lam ..... G01S 13/723 244/3.1
2010/0314487 A1 * 12/2010 Boelitz ..... G05D 1/105 701/13
2012/0123615 A1 5/2012 Bourzier
2016/0349026 A1 * 12/2016 Fairfax ..... F42B 10/26
2021/0055079 A1 * 2/2021 Choiniere ..... F41G 7/2253

FOREIGN PATENT DOCUMENTS

GB 1478267 A 6/1977

OTHER PUBLICATIONS

International Search Report, PCT/US2023/019939, mailed Feb. 21, 2024, 7 pages.

* cited by examiner

*Primary Examiner* — Marcus E Windrich
(74) *Attorney, Agent, or Firm* — Sand, Sebolt & Wernow LPA; Gary McFaline

(57) ABSTRACT

A guidance kit for a projectile and method for suppressing a point-of-interest (POI) at a desired location away from the POI. The guidance kit includes at least one processor in the guidance kit. The guidance kit also includes a guidance protocol operatively in communication with the guidance kit and the at least one processor and having a set of angular offset modes. The guidance protocol of the guidance kit is configured to guide the projectile to at least one location relative to a desired point-of-interest (POI) upon or in response to activation of at least one angular offset mode of the set of angular offset modes.

9 Claims, 10 Drawing Sheets

GUIDANCE KIT WITH VARIABLE ANGULAR OFFSET FOR UNDETECTED GROUND SUPPRESSION AND METHODS THEREOF

TECHNICAL FIELD

The present disclosure generally relates to ballistic weaponry and projectiles. More particularly, the present disclosure relates to guided ballistic weaponry and projectiles. Specifically, the present disclosure relates to a guidance kit that includes a guidance protocol for suppressing a targeted point of interest (POI) without indicating the launch location.

BACKGROUND

Aerial rockets and missiles which include guidance systems have been commonly used in the combat and military conflicts. In one specific instance, existing laser-guidance kits provide technology in guiding aerial rockets and missiles at a desired target via an independent light source (e.g., a laser or similar light source of the like) that is used to paint the target. As such, the independent light source is indexed and/or pointed at the desired target to guide the rocket to the desired target. An example of a guidance kit is the APKWS® laser-guidance kit that is generally equipped to a Hydra 70 rocket and/or a standard 2.75-inch "dummy" rocket for guiding the standard 2.75-inch rocket to the target.

Generally, rockets equipped with these laser-guidance kits may be launched from any suitable launch vehicle based on a specific mission, including ground launch vehicles configured for land or sea, fixed-wing air vehicles, rotary-wing air vehicles, and other suitable launchers capable of launching a rocket equipped with the laser-guidance kit. As such, these rockets equipped with these laser-guidance kits may be launched from a variety of launch vehicles where the launch vehicles are equipped with an independent light source for guiding the missiles with assistance from these laser-guidance kits.

Since these rockets equipped with the laser-guidance kit are guided by independent light sources, targeted points-of-interests (POIs) are able to detect and/or identify these independent light sources guiding these rockets. In other words, the targeted POIs may be placed on alert of these incoming rockets and prepare for such attacks. Moreover, the targeted POIs may be able to discover the location of the launch vehicle and/or the location of the light source guiding these rockets once the light source is detected. As such, these current laser-guidance kits create certain detriments for specific military operations in specific environments.

SUMMARY

The presently disclosed guidance protocol is operatively in communication with the guidance kit on a rocket or projectile and guides and/or controls the flight of the projectile without using external, independent light sources easily detectable by targeted POIs. The presently disclosed guidance protocol operatively in communication with the guidance kit also leverages current on-board devices and components of the guidance kit and the rocket motor by biasing the projectile towards a targeted location at a distance away from the targeted POI without an independent light source. The presently disclosed guidance protocol operatively in communication with the guidance kit also conceals and/or suppresses the location of the launch vehicle from the targeted POI, which may create confusion and misperception upon the targeted POI as to where these projectiles are being launched. As such, the guidance protocol disclosed herein addresses some of the inadequacies of previously known techniques and uses of guidance kits on a rocket or projectile.

In one aspect, an exemplary embodiment of the present disclosure may provide a guidance kit for a projectile. The guidance kit includes at least one processor in the guidance kit. The guidance kit also includes a guidance protocol operatively in communication with the guidance kit and the at least one processor and having a set of angular offset modes. The guidance protocol of the guidance kit is configured to guide the projectile to at least one location relative to a desired point-of-interest (POI) upon or in response to activation of at least one angular offset mode of the set of angular offset modes.

This exemplary embodiment or another exemplary embodiment may further provide at least one gyroscope operatively connected with the at least one processor; and at least one accelerometer operatively connected with the at least one processor; wherein the at least one gyroscope and the at least one accelerometer are configured to determine a down acceleration direction of the projectile at a predetermined time subsequent to launching the projectile from a launch vehicle. This exemplary embodiment or another exemplary embodiment may further provide a set of first codes provided with the guidance kit; and a first angular offset mode of the set of angular offset modes operatively in communication with the set of first codes; wherein the first angular offset mode is configured to activate the guidance protocol between an ON state and an OFF state. This exemplary embodiment or another exemplary embodiment may further provide at least one code of the set of first codes designates the first angular offset mode to activate the guidance protocol to the ON state. This exemplary embodiment or another exemplary embodiment may further provide at least another code of the set of first codes designates the first angular offset mode to deactivate the guidance protocol to the OFF state. This exemplary embodiment or another exemplary embodiment may further provide a set of second codes provided with the guidance kit; and a second angular offset mode the set of angular offset modes operatively in communication with the set of second codes; wherein the second angular offset mode is configured to bias the projectile between a first lateral position relative to the POI and a second lateral position relative to the POI; and wherein the first lateral position and the second lateral position are opposite to one another relative to the POI. This exemplary embodiment or another exemplary embodiment may further provide at least one range of codes of the set of second codes designates the second angular offset mode to bias the projectile to the first lateral position relative to the POI. This exemplary embodiment or another exemplary embodiment may further provide at least another range of codes of the set of second codes designates the second angular offset mode to bias the projectile to the second lateral position relative to the POI. This exemplary embodiment or another exemplary embodiment may further provide a set of third codes provided with the guidance kit; and a third angular offset mode the set of angular offset modes operatively in communication with the set of second codes; wherein the third angular offset mode is configured to bias the projectile between a first longitudinal position relative to the POI and a second longitudinal position relative to the POI; and wherein the first longitudinal position and the second longitudinal position are opposite to one another relative to the POI. This exemplary embodiment or another exemplary embodiment may further provide at least one range of codes of the set of third codes designates the third angular offset mode to bias the projectile to the first longitudinal position relative to the POI. This exemplary embodiment or another exemplary embodiment may further provide at least another range of codes of the set of second codes designates the third angular offset mode to bias the projectile to the second longitudinal position relative to the POI.

In another aspect, an exemplary embodiment of the present disclosure may provide a method of suppressing a point-of-interest (POI) at a desired location relative to the POI. The method comprises steps of providing a guidance protocol that is operatively in communication with a guidance kit of a projectile; determining the desired location to launch the projectile relative to the POI; selecting the guidance protocol between an ON state and an OFF state via a first angular offset of a set of angular offsets of the guidance protocol; launching the projectile, via a launch vehicle, at the desired location; determining a down acceleration direction asserted on the projectile, via one or both of at least one gyroscope and at least one accelerometer of the guidance kit, at a predetermined time subsequent to launching the projectile; and suppressing the POI, via the projectile, at the desired location relative to the POI.

This exemplary embodiment or another exemplary embodiment may further provide a step of activating the guidance protocol to the ON state via at least one code of a set of first codes of the guidance kit. This exemplary embodiment or another exemplary embodiment may further provide a step of deactivating the guidance protocol to the OFF state via at least another code of the set of first codes of the guidance kit. This exemplary embodiment or another exemplary embodiment may further provide a step of selecting the guidance protocol to bias the projectile, via a second angular offset of the set of angular offsets of the guidance protocol, between a first lateral position relative to the POI and a second lateral position relative to the POI; wherein the first lateral position and the second lateral position are opposite to one another relative to the POI. This exemplary embodiment or another exemplary embodiment may further provide a step of biasing the projectile, via at least one range of codes of a set of second codes designating the second angular offset mode, to the first lateral position relative to the POI. This exemplary embodiment or another exemplary embodiment may further provide a step of biasing the projectile, via at least another range of codes of the set of second codes designating the second angular offset mode, to the second lateral position relative to the POI. This exemplary embodiment or another exemplary embodiment may further provide a step of selecting the guidance protocol to bias the projectile, via a third angular offset of the set of angular offsets of the guidance protocol, between a first longitudinal position relative to the POI and a second longitudinal position relative to the POI; wherein the first longitudinal position and the second longitudinal position are opposite to one another relative to the POI. This exemplary embodiment or another exemplary embodiment may further provide a step of biasing the projectile, via at least one range of codes of a set of third codes designating the third angular offset mode, to the first longitudinal position relative to the POI. This exemplary embodiment or another exemplary embodiment may further provide a step of biasing the projectile, via at least another range of codes of the set of third codes designating the second angular offset mode, to the second longitudinal position relative to the POI.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

It should be understood that any use of the terms "suppress," "suppressed," "suppression," and other synonymous and/or derivative terms may relate to any use of force that degrades the performance of a threat or enemy force below the level needed to fulfill the mission and/or operation. Additionally, any use of the terms "suppress," "suppressed," "suppression," and other synonymous and/or derivative terms may also relate to hiding and/or concealing force on a threat or an enemy without said threat or enemy knowing or discovering the initial launch location of the force.

Figure 1:
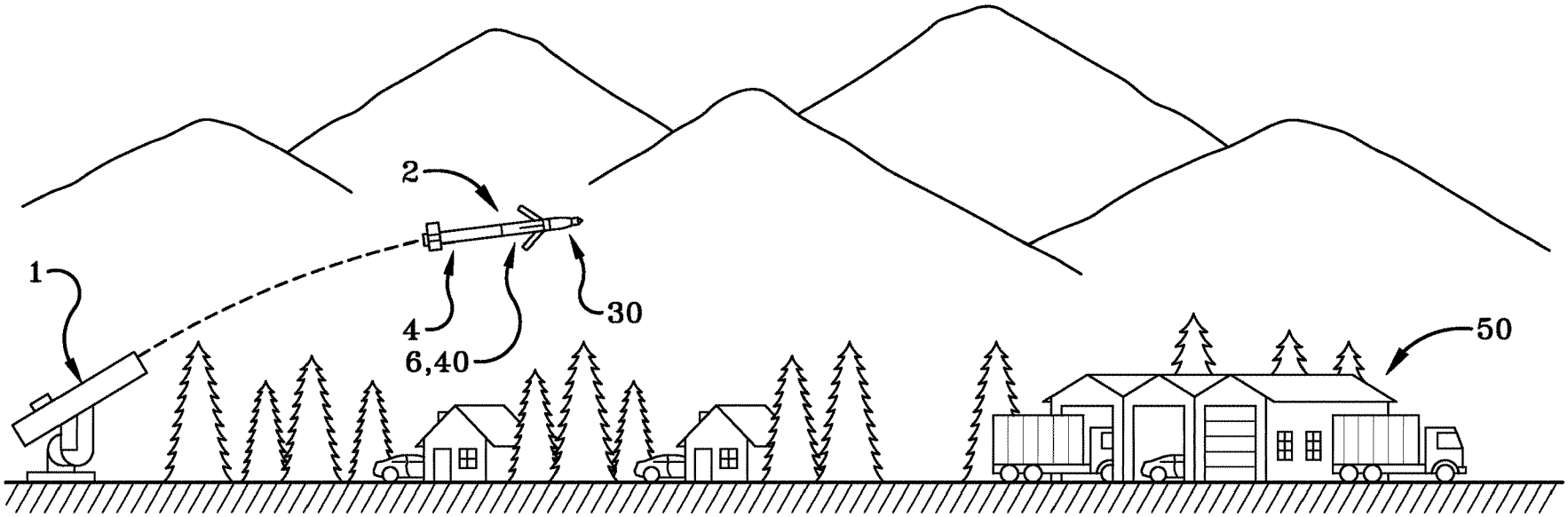
FIG. 1 is an operational view of a projectile being launched from a launch vehicle, wherein the projectile includes a guidance kit operatively in communication with a guidance protocol that is in accordance with the present disclosure.

FIG. 1 illustrates a launcher or a launch vehicle, generally referred herein as launch vehicle, launching a projectile or a guided rocket, generally referred herein as a projectile, towards a point of interest (POI) for suppression operations. The launch vehicle is indicated by the reference number 1 in FIGS. 1 and 6A-6D. As illustrated in FIGS. 1 and 6A-6D, the illustrated launch vehicle 1 is a ground launch vehicle that is operably engaged with a ground surface and is configured to launch surface-to-surface projectiles or missiles (or "SSM") or ground-to-ground projectiles or missiles (or "GGM"). In other words, the illustrated launch vehicle 1 is capable of launching projectiles and other similar devices from land and striking targets on land or sea.

It will be understood that the illustrated launch vehicle 1 is exemplary only and any type of launch vehicle is contemplated to be represented by the illustrated device. In one exemplary embodiment, the launch vehicle 1 may be represented as hand-held launcher, a launcher fixed to a ground transporting vehicle, a launcher fixed to a naval vehicle, or other suitable launchers for launching projectiles and other similar devices from land or sea and striking targets on land or sea. In another exemplary embodiment, the launch vehicle 1 may be also represented with an air vehicle (e.g., fixed-wing launch platforms, rotary-wing launch platforms) that is capable of launching projectiles and other similar payloads from air and striking targets in air, on land, or at sea.

As illustrated in FIGS. 1-5D, the illustrated projectile 2 is a projectile equipped with a guidance kit for guiding the illustrated projectile 2 to a specific target. As provided herein, the illustrated projectile 2 is a Hydra 70 rocket equipped with a laser-guidance kit for guiding the illustrated projectile 2 to a specific target. Such use and purpose of the laser-guidance kit with the illustrated projectile 2 is described in more detail below.

Figure 2:
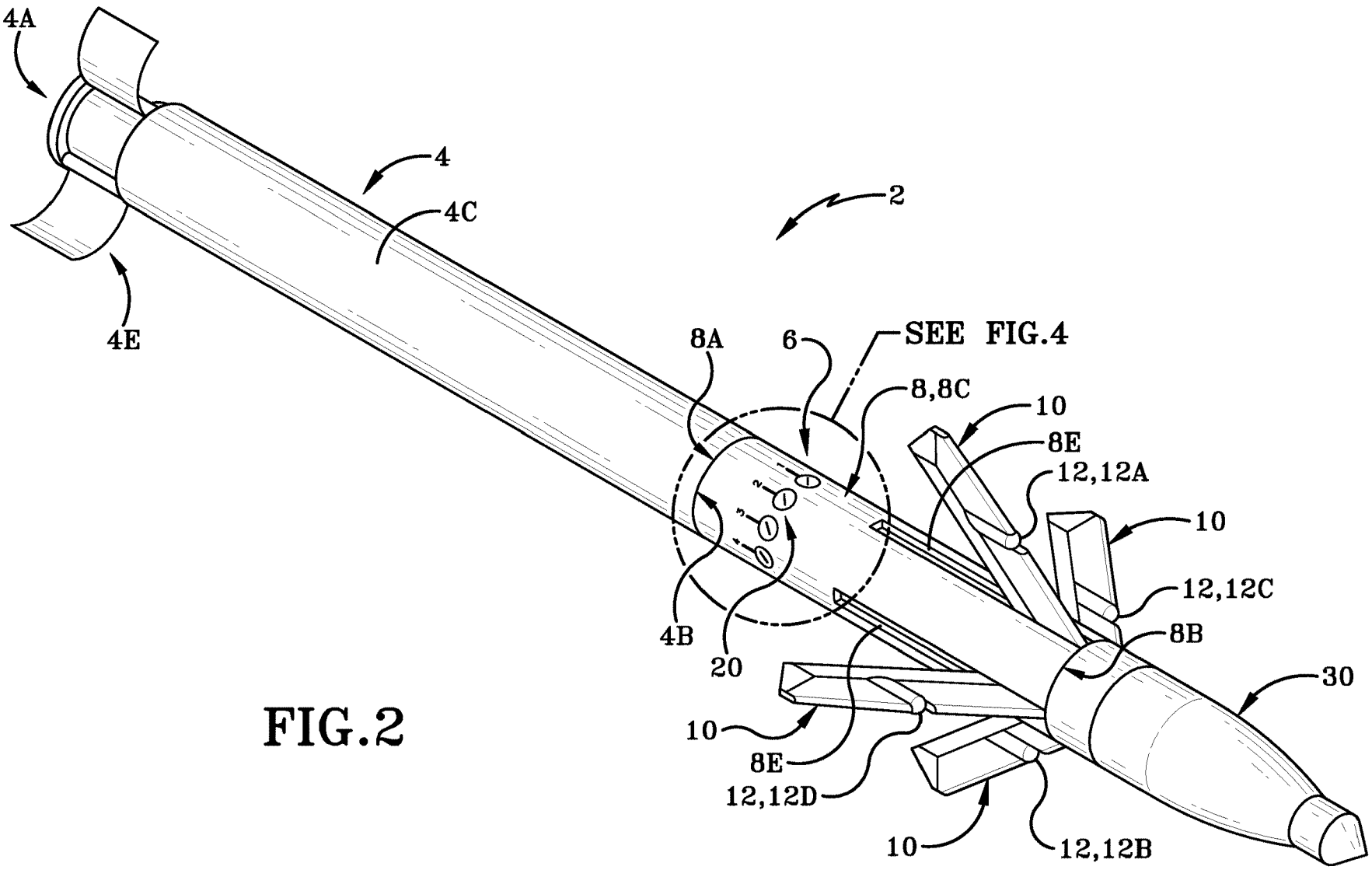
FIG. 2 is a top, front, right side isometric perspective view of the projectile that includes the guidance protocol in accordance with the present disclosure.
Figure 3:
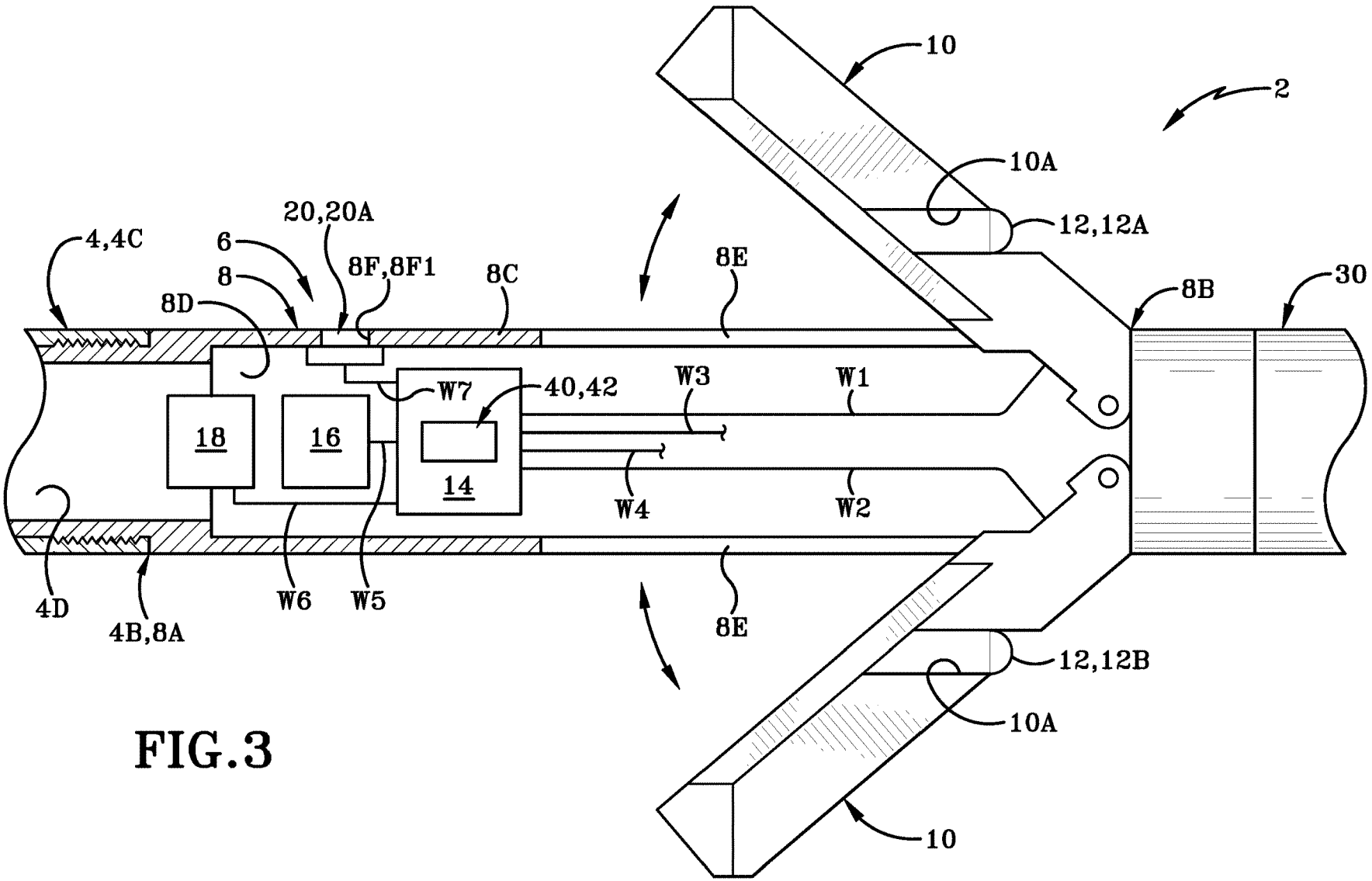
FIG. 3 a partial sectional view of the projectile showing a portion of the guidance kit operatively in communication with the guidance protocol.

Referring to FIGS. 2 and 3, the projectile 2 includes a rocket motor or engine 4 configured to provide suitable propulsion and thrust needed for a desired operation. The rocket motor 4 includes a first end 4A, a second end 4B opposite to the first end 4A, and a longitudinal axis defined therebetween. The rocket motor 4 also includes a circumferential wall 4C that extends between the first end 4A and the second end 4B along the longitudinal axis of the rocket motor 4. The circumferential wall 4C of the rocket motor 4 also defines a chamber 4D that extends between the first end 4A and the second end 4B. While not illustrated herein, suitable rocket propellants and elements are stored inside of the chamber 4D that generate propulsion and thrust for the rocket motor 4. The rocket motor 4 also includes an aft fin member 4E operably engaged with the circumferential wall 4C proximate to the first end 4A of the rocket motor 4. The aft fin member 4E may provide flight assistance to the projectile 2 at the first end 4A of the rocket motor 4 as the projectile 2 travels through the air between the initial launch at the launch vehicle 1 and a targeted POI.

In the illustrated embodiment, the rocket motor 4 of the projectile 2 is a standard 2.75-inch rocket motor (e.g., liquid-fueled rocket motors, solid-fueled rocket motors, or other suitable rocket motors of the like). In other exemplary embodiments, any suitable rocket motor may be equipped for a projectile based on the mission and/or objective.

Referring to FIGS. 2 and 3, the projectile 2 also includes a guidance kit 6 that is configured to guide the projectile 2 to a specific target. The guidance kit 6 may include legacy hardware and methods that are configured to initiate and/or deploy on-board devices to guide and/or direct the projectile 2 to a specific target. The guidance kit 6 is also configured to operably engaged with a rocket motor, such as rocket motor 4, to enable guidance capabilities to the rocket motor. As described above, the guidance kit 6 provided with the projectile 2 is a legacy laser guidance kit and/or apparatus. In one example, a legacy guidance kit described and illustrated herein may be an APKWS laser guidance kit manufactured by BAE Systems. In another example, a legacy guidance kit described and illustrated herein may be a preexisting or legacy laser guidance kit. It should be understood that any devices, components, and/or systems described herein that forms the guidance kit 6 described herein are provided in the laser-guidance kit.

Still referring to FIGS. 2 and 3, the guidance kit 6 includes body 8 that operably engages with the rocket motor 4. The body 8 includes a first end 8A that operably engages with the rocket motor 4 at the second end 4B of the rocket motor 4, a second end 8B opposite to the first end 6A, and a longitudinal axis defined therebetween. The body 8 also includes a circumferential wall 8C that extends between the first end 8A and the second end 8B. The circumferential wall 8C of the body 8 also defines a chamber 8D that extends between the first end 8A and the second end 8B; devices and components operably engaged with the body 8 that are positioned inside of the chamber 8D are described in more detail below. The circumferential wall 8C of the body 8 also defines a set of channels 8E that extend entirely through the circumferential wall 8C where the chamber 8D and the exterior environment are in fluid communication with one another via the set of channels 8E; such use of the set of channels 8E is described in more detail below.

Figure 4:
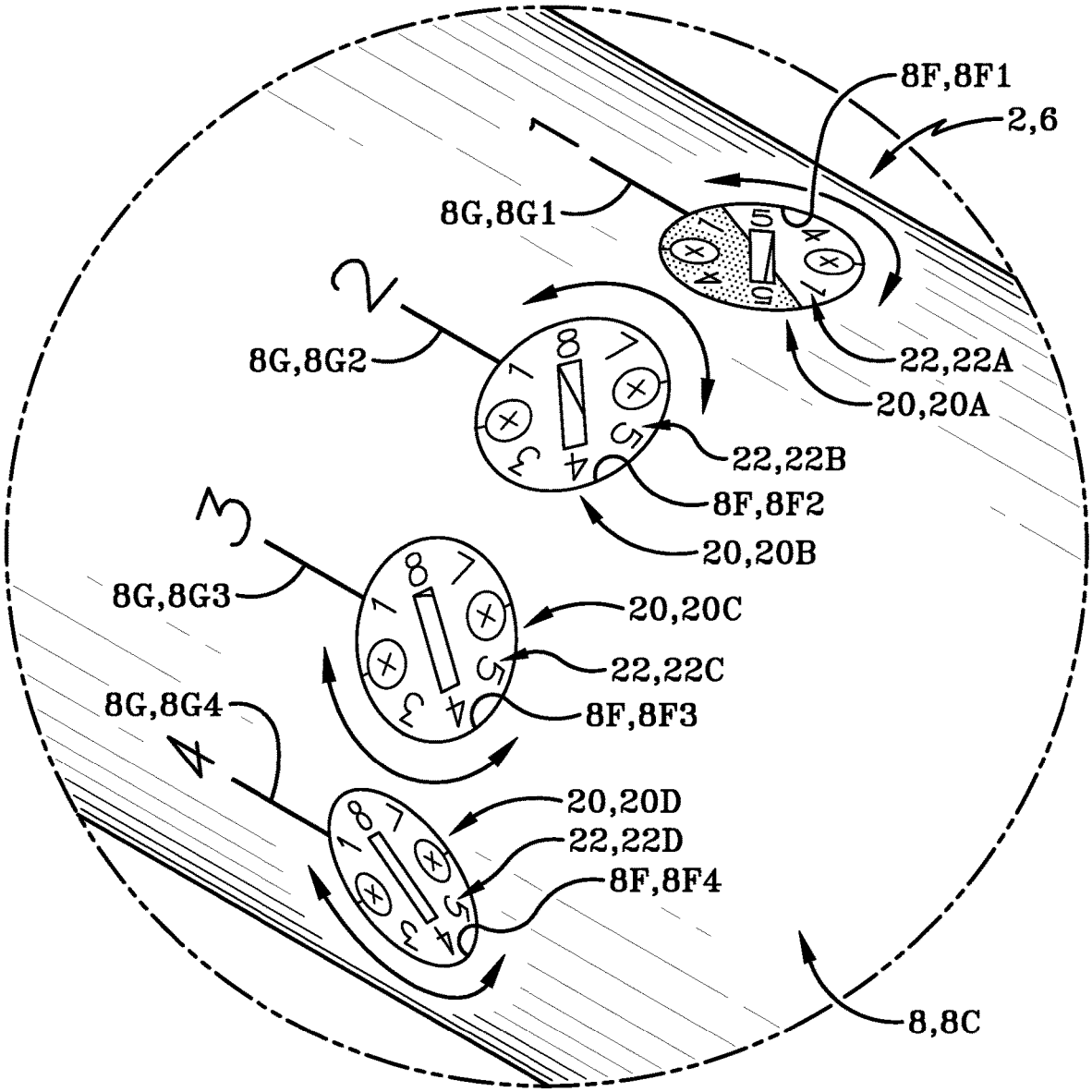
FIG. 4 is an enlargement view of the highlighted region shown in FIG. 3 of a set of switches of the guidance kit.

Still referring to FIGS. 2 and 3, the body 8 also defines a set of openings 8F that that extend entirely through the circumferential wall 8C where the chamber 8D and the exterior environment are in fluid communication with one another via the set of openings 8F; such use of the set of openings 8F is described in more detail below. As illustrated herein, the set of openings 8F includes four openings defined in the circumferential wall 8C. The body 8 also includes a set of indicator 8G scribed and/or provided on the circumferential wall 8C exterior to the chamber 8D. As illustrated herein, the set of indictors 8G includes four indictors scribed and/or provided on the circumferential wall 8C exterior to the chamber 8D. As illustrated in FIGS. 2 and 4, a first indicator 8G1 of the set of indicators 8G is aligned with a first opening 8F1 of the set of openings 8F, a second indicator 8G2 of the set of indicators 8G is aligned with a second opening 8F2 of the set of openings 8F, a third indicator 8G3 of the set of indicators 8G is aligned with a third opening 8F3 of the set of openings 8F, and a fourth indicator 8G4 of the set of indicators 8G is aligned with a fourth opening 8F4 of the set of openings 8F. Such use of the set of indictors 8F is described in more detail below.

Still referring to FIGS. 2 and 3, the guidance kit 6 also includes a set of retractable flaperons or wings 10 operably engaged with the body 8 of the guidance kit 6. Each retractable wing of the set of retractable wings 6H is moveable on the body 8 at the second end 8B of the body 8. During operation, the set of retractable wings 10 pivotable outwardly from the body 8, via the set of channels 8E, when the projectile 2 is launched and travels through the air. Additionally, each retractable wing of the set of retractable wings 10 also defines a cavity 10. The cavity 10 defined in each retractable wing of the set of retractable wings 10 is configured to house an optic device 12 that operably engages with the respective retractable wing in the set of retractable wings 10. It should be understood that the illustrated optic device 12 operably engaged with each retractable wing of the set of retractable wings 20 uses a distributed aperture semi-active laser seeker that is one example of a seeker technology developed and manufacture by BAE Systems.

Referring to FIG. 3, at least one processor or microprocessor 14 is housed inside of the chamber 8D of the body 8. In the illustrated embodiment, a single processor 14 is illustrated herein for schematic purposes. In other exemplary embodiments, any suitable number of processors may be provided with a projectile for specific a military operation (e.g., guidance protocols and methods). The processor 14 is configured to logically perform protocols and/or methods that are provided on the processor 14 prior to military operation, including guidance protocols and methods used in an existing laser guidance kit. The processor 14 may also be powered by an on-board power source and/or power supply (e.g., portable battery, etc.) in order to logically perform protocols and/or methods that are operatively in communication with the processor 14.

As illustrated in FIG. 3, the processor 14 is operatively connected with each optic device 12 via an electrical connection such as wire or other similar electrical connection of the like. In FIG. 3, the processor 14 is operatively connected with a first optic device 12A via a first electrical connection W1. With such electrical connection, via the first electrical connection W1, the first optic device 12A and the processor 14 are enabled to communicate with one another during a military operation. Still referring to FIG. 3, the processor 14 is also operatively connected with a second optic device 12B via a second electrical connection W2. With such electrical connection, via the second electrical connection W1, the second optic device 12B and the processor 14 are also enabled to communicate with one another during a military operation. Still referring to FIG. 3, the processor 14 is also operatively connected with third and fourth optic devices 12C, 12D via third and fourth electrical connections W3, W4. With such electrical connection, via the third and fourth electrical connections W3 and W4, the third optic device 12C and the processor 14 are also enabled to communicate with one another during a military operation, and the fourth optic device 12D and the processor 14 are also enabled to communicate with one another during a military operation.

Still referring to FIG. 3, in one example there is at least one accelerometer 16 operatively connected with the processor 14 and provided inside of the chamber 6D of the guidance kit 6. In the illustrated embodiment, a single accelerometer 16 is illustrated herein for schematic and diagrammatic purposes. In other exemplary embodiments, any suitable number of accelerometers may be provided with a projectile for specific a military operation (e.g., guidance protocols and methods). As shown in FIG. 3, the accelerometer 16 is operatively connected with the processor 14 via a fifth electrical connection W5. Such connection between the accelerometer 16 and the processor 14, via the fifth electrical connection W5, enables the accelerometer 16 and the processor 14 to communicate with one another during a military operation; such use and purpose of the accelerometer 16 during a military operation is described in more detail below.

Still referring to FIG. 3, in one example there is at least one gyroscope 18 is operatively connected with the processor 14 and provided inside of the chamber 6D of the guidance kit 6. In the illustrated embodiment, a single gyroscope 18 is illustrated herein for schematic purposes. In other exemplary embodiments, any suitable number of gyroscopes may be provided with a projectile for specific a military operation (e.g., guidance protocols and methods). As shown in FIG. 3, the gyroscope 18 is operatively connected with the processor 14 via a sixth electrical connection W6. Such connection between the gyroscope 18 and the processor 14, via the sixth electrical connection W6, enables the gyroscope 18 and the processor 14 to communicate with one another during a military operation; such use and purpose of the gyroscope 18 during a military operation is described in more detail below.

Referring to FIGS. 2-4, in one embodiment there are a set of switches or inputs 20 operably engaged with the guidance kit 6 and operatively connected with the processor 14. As illustrated in FIGS. 3 and 4, the set of switches 20 are operably engaged with the guidance kit 6 inside of the set of openings 8F defined by the body 8. As illustrated in FIG. 4, a first switch 20A of the set of switches 20 operably engages with the body 8 inside of the first opening 8F1 of the set of openings 8. Similarly, second, third, and fourth switches 20B, 20C, 20D also operably engage with the body 8 inside of the second, third, and fourth openings 8F2, 8F3, 8F4. Additionally, the first, second, third, and fourth switches 20A, 20B, 20C, 20D of the set of switches 20 are also operatively connected with the processor 14 via electrical connections. In particular, the first switch 20A is electrically connected with the processor 14 via a seventh electrical connection W7. Such connection between the first switch 20A and the processor 14, via the seven electrical connection W7, enables the first switch 20A and the processor to communicate with one another during a military operation. While not illustrated herein, the second, third, and fourth switches 20B, 20C, 20D are also electrically connected with the processor 14 via electrical connections similar to the seventh electrical connection W7 between the first switch 20A and the processor 14. Such connection between the second, third, and fourth switches 20B, 20C, 20D and the processor 14, via electrical connections, also enables each of the second, third, and fourth switches 20B, 20C, 20D to communicate with the processor 14 during a military operation. Such use of the set of switches is described in more detail below.

The guidance kit 6 also includes sets of codes logically provide with the process 14 to provide guidance commands and/or instructions to the projectile 2. Referring to FIG. 4, these sets of codes 22 are labeled on the sets of switches 20 to enable an operator to manually select a desired code combination for a desired guidance protocol to be performed by the processor 14 for a specific military operation, which is described in more detail below. As such, the first switch 20A has a set of first codes 22A that may enable specific predetermined parameters or modes for specific and predetermined protocols and/or methods to be performed by the processor 14 for a specific military operation. Additionally, the second, third, and fourth switches 20B, 20C, 20D also have set of second, third, and fourth codes 22B, 22C, 22D that are dedicated to the respective switch 20B, 20C, 20D. Such use and purpose of these set of codes 22 is described in more detail below. In other exemplary embodiments, the sets of codes 22 provided in the guidance kit 6 may also be automatically selected via a remote electronic device operatively connected with a guidance kit without using the set of switches 20.

As illustrated in FIG. 4, each set of codes 22A, 22B, 22C, 22D includes numerical values that enable an operator of the projectile 2 to select at least one switch 20A, 20B, 20C, 20D at a desired mode by aligning the specific numerical value with the respective indicators of the set of indicators 8G. For example, a specific numerical value (e.g., numerical value 1 in the shaded portion of the first set of codes 22 as shown in FIG. 4) provided in the set of first positions codes 22A may be assigned to activate or deactivate a specific and predetermined protocol and/or method performed by the processor 14 for a specific military operation. In this same example or other examples, the remaining numerical values in the shaded portion of the first set of codes 22 (i.e., numerical value 2 through numerical value 5) and the numerical values in the non-shaded portion of the first set of positions (i.e., numerical value 1 through numerical value 5) may be assigned to activate or deactivate a specific and predetermined protocols and/or methods performed by the processor 14 for a specific military operation. Such operation of using these sets of codes 22 is described in more detail below.

Referring to FIG. 2, the projectile 2 also includes a payload 30 that is operably engaged with the body 8 of the guidance kit 6. More particularly, the payload 30 operably engages with the body 8 of the guidance kit 6 at the second end 8B of the body 8. The illustrated payload 30 may be a standard warhead and fuse that is capable of being used with the illustrated rocket motor 4 being a standard 2.75-inch diameter rocket motor.

Figure 5:
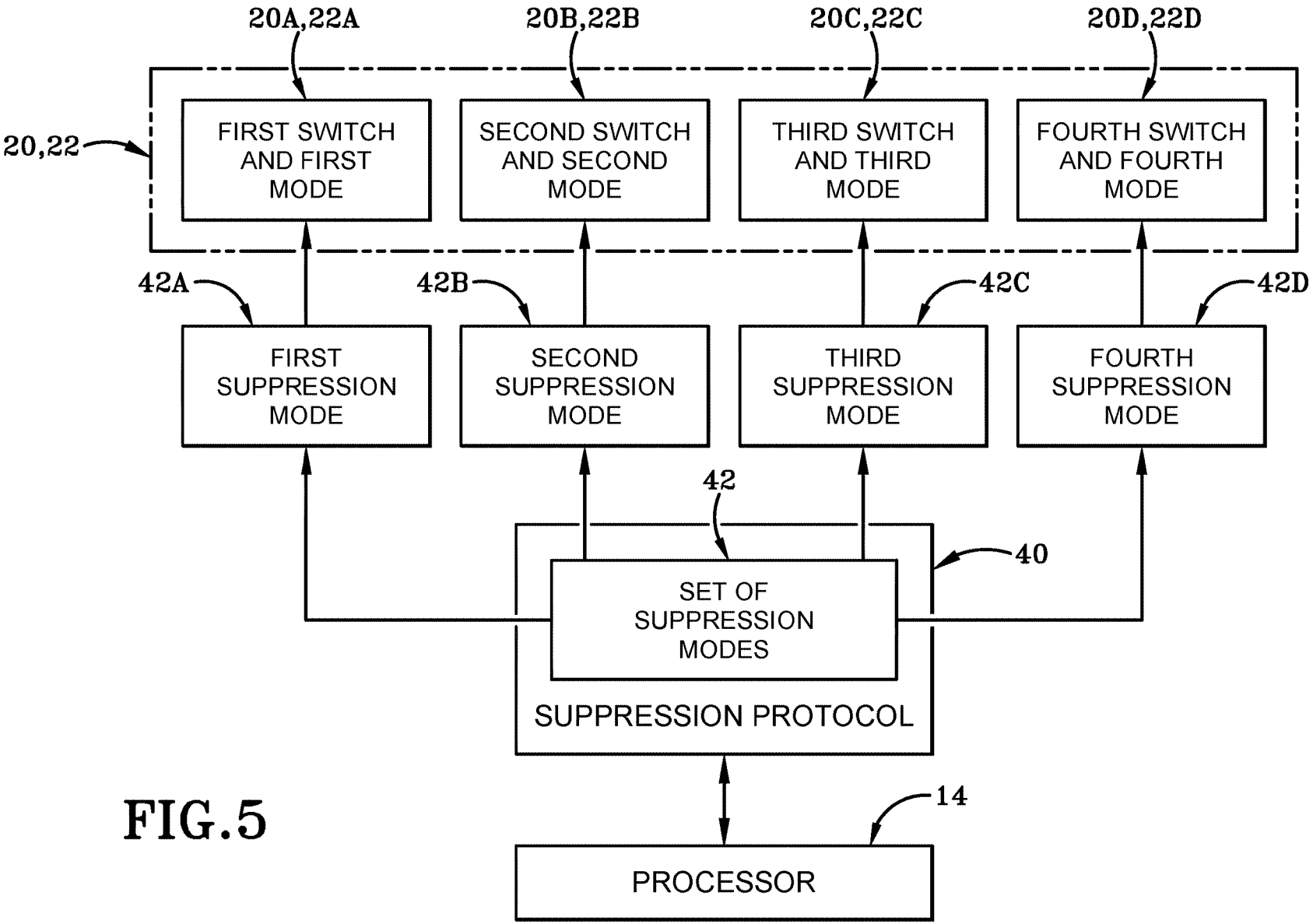
FIG. 5 is a schematic flowchart of the guidance protocol in communication with certain components of the guidance kit of the projectile.

As illustrated in FIGS. 3-5, a guidance protocol 40 is provided with the guidance kit 6. Referring to FIGS. 3 and 5, the guidance protocol 40 is operatively in communication with the processor 14 of the guidance kit 6 prior to any specific military operation. The guidance protocol 40 enables the processor 14 along with the accelerometer 16, the gyroscope 18, the set of switches 20 with the associated sets of codes 22 to provide suppressive fire at a specific point of interest (POI). As described in more detail below, the illustrated guidance protocol 40 uses the accelerometer 16 and the gyroscope 18 from the guidance kit 6 to help guide the projectile 2 without any external and/or independent devices and/or components remote from the projectile 2 (e.g., lasers and other similar devices of the like).

As illustrated in FIG. 5, the guidance protocol 40 includes a set of angular offset parameters or modes 42 to enable the guidance kit 6 into an angular offset mode and to bias the projectile 2 towards a predetermined target relative to a POI via the rocket motor 4 for suppressive fire operations. Upon the guidance protocol 40 being logically inputted into the guidance kit 6, the set of angular offset codes 42 of the guidance protocol 40 are added and/or supplemented with the legacy sets of codes 22 provided with guidance kit 6. As such, the guidance protocol 40 leverages current devices and components of the guidance kit 6 (i.e., the processor 14, accelerometer 16, gyroscope 18, and other devices or components provided in the guidance kit 6) to assist in guiding and/or directing the projectile 2 during flight.

Referring to FIG. 5, the guidance protocol 40 includes a first angular offset mode or an authorization mode 42A. In one example, the first angular offset mode 42A may be is logically mapped to or logically assigned to one of the first, second, third, and fourth switches 20A, 20B, 20C, 20D. In the illustrated embodiment, the first angular offset mode 42A of the set of angular offset modes 42 is logically mapped to the first switch 20A. In other exemplary embodiments, a first angular offset angular offset mode of a set of angular offset angular offset modes may be logically mapped to or logically assigned to any switch of a set of switches described herein for controlling the first angular offset mode. In the guidance protocol 40, the first angular offset mode 42A in the set of angular offset modes 42 enables the guidance protocol 40 to be activated to an ON state and to be deactivated to an OFF state based on the selected mode from the set of first codes 22A of the first switch 20A. In other exemplary embodiments, a remote electronic device operatively connected with a guidance kit may logically control a first angular offset of a set of angular offset modes to activate a guidance protocol to an ON state and deactivate the guidance protocol to an OFF state without using of any switch of a set of switches provided in the guidance kit.

As illustrated in FIGS. 4 and 5, at least one numerical value labeled in the set of first codes 22A of the first switch 20A is logically mapped to the first angular offset mode 42A to activate operation of the guidance protocol 40 to an ON state. Additionally, at least another numerical value labeled in the set of first codes 22A of the first switch 20A may also logically mapped to the first angular offset mode 42A to deactivate operation of the guidance protocol to an OFF state. In one example, numerical value "1" labeled in the shaded portion of the set of first codes 22A of the first switch 20A (see FIG. 4) may be mapped to the first angular offset mode 42A to activate the guidance protocol 40 to the ON state. In the same example, numerical value "1" labeled in the non-shaded portion of the set of first codes 22A of the first switch 20A (see FIG. 4) may be mapped to the first angular offset mode 42A to deactivate the guidance protocol 40 to the OFF state. As such, an operator may rotate the first switch 20A to a desired position in the set of first codes 22A to activate or deactivate the guidance protocol 40 during a military operation, which is described in more detail below. In one exemplary embodiment, an operator may logically operate a first angular offset mode between an ON state and an OFF state via a remote electronic device operatively connected with a guidance kit without use of a first switch of the sets of switches.

Referring to FIG. 5, the guidance protocol 40 also includes a second angular offset mode or a lateral biasing mode 42B that is logically mapped to or logically assigned to one of the first, second, third, and fourth switches 20A, 20B, 20C, and 20D. In the illustrated embodiment, the second angular offset mode 42B of the set of angular offset modes 42 is logically mapped to the second switch 20B. In other exemplary embodiments, a second angular offset mode of a set of angular offset modes may be logically mapped to or logically assigned to any switch of a set of switches described herein. In the guidance protocol 40, the second angular offset mode 42B in the set of angular offset modes 42 enables the projectile 2 to be biased laterally relative to a POI via commands sent from the processor 14 to the rocket motor 4 and the guidance kit 6. In other words, activation of the second angular offset mode 42B via the second switch 20B will bias and/or guide the projectile 2 at a targeted location at a distance away from a POI where the target location is lateral to the POI, which is described in more detail below. In other exemplary embodiments, a remote electronic device operatively connected with a guidance kit may logically control a second angular offset of a set of angular offset modes without using any switch of a set of switches provided in the guidance kit.

As illustrated in FIGS. 4 and 5, at least one numerical value or at least one range of numerical values labeled in the set of second codes 22B of the second switch 20B is logically mapped to the second angular offset mode 42B to apply a first lateral bias to the projectile 2 via commands sent from the processor 14 to the rocket motor 4 and the guidance kit 6. Additionally, at least another numerical value or at least another range of numerical values labeled in the set of second codes 22B of the second switch 20B is logically mapped to the second angular offset mode 42B to apply a second lateral bias to the projectile 2 opposite to the first lateral bias via the rocket motor 4 and the guidance kit 6. In one example, numerical value "1" labeled in the set of second codes 22B of the second switch 20B may be mapped to the second angular offset mode 42B to apply a first lateral bias to the projectile 2 via the rocket motor 4 and the guidance kit 6. In the same example, numerical value "5" labeled in the set of second codes 22B of the second switch 20B may be mapped to the second angular offset mode 42B to apply a second lateral bias to the projectile 2 opposite to the first lateral bias via the rocket motor 4 and the guidance kit 6. In another example, a first range of numerical values "1" through "4" labeled in the set of second codes 22B of the second switch 20B may be mapped to the second angular offset mode 42B to apply a range of first lateral bias to the projectile 2 via the rocket motor 4 and the guidance kit 6. In the same example, a second range of numerical values "5" through "8" labeled in the set of second codes 22B of the second switch 20B may be mapped to the second angular offset mode 42B to apply a range of second lateral bias to the projectile 2 opposite to the first lateral bias via the rocket motor 4 and the guidance kit 6.

It should be understood that the second angular offset mode 42B provided in the guidance protocol 40 is dependent upon the first angular offset mode 42A. In other words, the second angular offset mode 42B is only activated when the first angular offset mode 42A is activated to the ON state by an operator of the projectile 2. As such, the second angular offset mode 42B is only performed by the processor 14 when the operator selects the predetermined numerical value of the set of first codes 22A of the first switch 20A to activate the first angular offset mode 42A to the ON state. In other exemplary embodiments, an operator may logically operate a second angular offset mode input via a remote electronic device operatively connected with a guidance kit without using any switch of a set of switches provided in the guidance kit.

Referring to FIG. 5, the guidance protocol 40 also includes a third angular offset mode or a longitudinal biasing mode 42C that is logically mapped to or logically assigned to one of the first, second, third, and fourth switches 20A, 20B, 20C, and 20D. In the illustrated embodiment, the third angular offset mode 42C of the set of angular offset modes 42 is logically mapped to the third set of codes 22C of the third switch 20C. In other exemplary embodiments, a third angular offset mode of a set of angular offset modes may be logically mapped to any switch of a set of switches described herein. In the guidance protocol 40, the third angular offset mode 42C in the set of angular offset modes 42 enables the projectile 2 to be biased longitudinally relative to a POI via commands sent from the processor 14 to the rocket motor 4 and the guidance kit 6. In other words, activation of the third angular offset mode 42C via the third switch 20C will bias and/or guide the projectile 2 at a targeted location at a distance away from a POI where the target location is longitudinal to the POI, which is described in more detail below. In other exemplary embodiments, a remote electronic device operatively connected with a guidance kit may logically control a third angular offset of a set of angular offset modes without using any switch of a set of switches provided in the guidance kit.

As illustrated in FIGS. 4 and 5, at least one numerical value or at least one range of numerical values labeled in the set of third codes 22C of the third switch 20C is logically mapped to the third angular offset mode 42C to apply a first longitudinal bias to the projectile 2 via commands sent from the processor 14 to the rocket motor 4 and the guidance kit 6. Additionally, at least another numerical value or at least another range of numerical values labeled in the set of third codes 22C of the third switch 20C is logically mapped to the third angular offset mode 42C to apply a second longitudinal bias to the projectile 2 opposite to the first longitudinal bias via the rocket motor 4 and the guidance kit 6. In one example, numerical value "1" labeled in the set of third codes 22C of the third switch 20C may be mapped to the third angular offset mode 42C to apply a first longitudinal bias to the projectile 2 via the rocket motor 4 and the guidance kit 6. In the same example, numerical value "5" labeled in the set of third codes 22C of the third switch 20C may be mapped to the third angular offset mode 42C to apply a second longitudinal bias to the projectile 2 opposite to the first longitudinal bias via the rocket motor 4 and the guidance kit 6. In another example, a first range of numerical values "1" through "4" labeled in the set of third codes 22C of the third switch 20C may be mapped to the third angular offset mode 42C to apply a range of first longitudinal bias to the projectile 2 via the rocket motor 4 and the guidance kit 6. In the same example, a second range of numerical values "5" through "8" labeled in the set of third codes 22B of the third switch 20C may be mapped to the third angular offset mode 42C to apply a range of second longitudinal bias to the projectile 2 opposite to the first longitudinal bias via the rocket motor 4 and the guidance kit 6.

It should be understood that the third angular offset mode 42C provided in the guidance protocol 40 is dependent upon the first angular offset mode 42A. In other words, the third angular offset mode 42C is only activated when the first angular offset mode 42A is activated to the ON state by an operator of the projectile 2. As such, the third angular offset mode 42C is only performed by the processor 14 when the operator selects the predetermined numerical value of the set of first codes 22A of the first switch 20A to activate the first angular offset mode 42A to the ON state. In other exemplary embodiments, an operator may logically operate a third angular offset mode input via a remote electronic device operatively connected with a guidance kit without using any switch of a set of switches provided in the guidance kit.

Referring to FIG. 5, the guidance protocol 40 also includes a fourth angular offset mode or an auxiliary mode 42D that is logically mapped to or logically assigned to one of the first, second, third, and fourth switches 20A, 20B, 20C, and 20D. In the illustrated embodiment, the fourth angular offset mode 42D of the set of angular offset modes 42 is logically mapped to the fourth set of codes 22D of the fourth switch 20D. In other exemplary embodiments, a fourth angular offset mode of a set of angular offset modes may be logically mapped to or logically assigned to any switch of a set of switches described herein. In the guidance protocol 40, the fourth angular offset mode 42D in the set of angular offset modes 42 enables auxiliary capabilities and/or features that enhance or deter features of the guidance protocol; such exemplary auxiliary capabilities and features provided by the fourth angular offset mode 42D is described in more detail below. In other exemplary embodiments, a remote electronic device operatively connected with a guidance kit may logically control a fourth angular offset of a set of angular offset modes without using any switch of a set of switches provided in the guidance kit.

As illustrated in FIGS. 4 and 5, at least one numerical value or at least one range of numerical values labeled in the set of fourth codes 22D of the fourth switch 20D is logically mapped to the fourth angular offset mode 42D to enable a first auxiliary capability and/or feature that enhances or deters features of the guidance protocol 40. Additionally, at least another numerical value or at least another range of numerical values labeled in the set of fourth codes 22D of the fourth switch 20D is logically mapped to the fourth angular offset mode 42D to apply a second auxiliary capability and/or feature that enhances or deters features of the guidance protocol 40; the second auxiliary feature is different than the first auxiliary feature. In one example, numerical value "1" labeled in the set of fourth codes 22D of the fourth switch 20D may be mapped to the fourth angular offset mode 42D to apply a first auxiliary capability and/or feature that enhances or deters features of the guidance protocol 40. In the same example, numerical value "2" labeled in the set of fourth codes 22C of the fourth switch 20C may be mapped to the fourth angular offset mode 42D to apply second auxiliary capability and/or feature that enhances or deters features of the guidance protocol 40. In other exemplary embodiments, any suitable numerical values labeled in the set of the fourth codes 22C of the fourth switch 22 may be mapped to the fourth angular offset mode 42D to apply any suitable auxiliary capabilities and/or features to enhances or deters features of the guidance protocol 40

It should be understood that the fourth angular offset mode 42D provided in the guidance protocol 40 may be dependent upon the first angular offset mode 42A. In other words, the fourth angular offset mode 42D may only be activated when the first angular offset mode 42A is activated to the ON state by an operator of the projectile 2. As such, the fourth angular offset mode 42D is only performed by the processor 14 when the operator selects the predetermined numerical value of the set of first codes 22A of the first switch 20A to activate the first angular offset mode 42A to the ON state. It should also be understood that the fourth angular offset mode 42D may enable an auxiliary feature that overrides and/or takes priority over the first angular offset mode 42A even though the first angular offset mode 42A is activated to the ON state; such exemplary auxiliary features are described in more detail below. In other exemplary embodiments, an operator may logically operate a fourth angular offset mode input via a remote electronic device operatively connected with a guidance kit without using any switch of a set of switches provided in the guidance kit.

Having now described the component and devices of the projectile 2 that includes the guidance protocol 40, a method of using the projectile 2 with the guidance protocol 40 is described in more detail below.

Prior to launching the projectile 2, the guidance protocol 40 is logically provided into the guidance kit 6 in which the processor 12 of the guidance kit 6 may utilize said guidance protocol 40 for suppression operations and tasks. Such inputting of the guidance protocol 40 into the guidance kit 6 may take place prior to the projectile 2 being used for a mission and/or operation.

Prior to launching the projectile, an operator may also determine the location of a POI; the POI is generally referred to numerical reference 50 in FIGS. 1 and 6A-6D. While not illustrated herein, the POI 50 may be located near or surrounded by natural obstructions that created visual obstructions in viewing the POI 50 (e.g., mountain ranges, forests, large bodies of water, etc.). In this method of use, the POI 50 may also be a hostile and/or dangerous threat to the operator of the projectile 2; as such, the operator may be instructed to provide the guidance kit 6 into an angular offset mode via the guidance protocol 40.

Once the POI 50 has been determined by the operator or has been communicated to the operator, the operator may then provide the set of switches 20 in at least one predefined combination, via the set of codes 22, to enable the guidance protocol 40 for the guidance kit 6. Such combination of the set of switches 20 as selected by the operator may be made based on various considerations, including natural obstructions that protect and/or surround the POI 50 (see examples above), size and layout of the POI 50, orientation of the launch vehicle 1 relative to the POI 50, the number of projectiles 2 being launched from at least one launch vehicle, and other considerations of the like when selecting a desired combination for the set of switches 20. In one exemplary embodiment, an operator may set the angular offset modes 42 of the guidance protocol 40 to any suitable position via a remote electronic device operatively connected with a guidance kit without using any switch of a set of switches provided in the guidance kit.

Once the guidance protocol 40 has been determined by the operator or has been communicated to be performed by the operator, the operator may then select a predetermined position to provide one of the first, second, third, or fourth switches 20A, 20B, 20C, 20D to authorize and/or initiate the guidance protocol 40. In the illustrated embodiment, the first switch 20A is logically mapped to the first angular offset mode 42A from the set of angular offset modes 42 to activate the guidance protocol 40 to the ON state. Additionally, the operator may be given or have knowledge of a first predetermined position to position the first switch 20A relative to the first indicator 8G1 on the body 8 to activate the guidance protocol to the ON state. In this embodiment, the first predetermined position to activate the guidance protocol to the ON state will be an available numerical value labeled in the set of first codes 22A provided with the first switch 20A. Once the operator has knowledge of the first predetermined position, the operator will then turn the first switch 20A, either clockwise or counterclockwise, until the numerical valve labeled in the set of first codes 22A that activates the guidance protocol 40 aligns with the first indicator 8G1 on the body 8. Once aligned, the guidance protocol 40 has been activated to the ON state in the processor 14.

Upon activation of the guidance protocol 40, the operator may bias the projectile 2 in any suitable direction depending on the considerations previously listed above. As described above, the second and third suppressions modes 42B, 42C of the set of angular offset modes 42 are only available when the guidance protocol 40 is activated to the ON state. As such, the following embodiments provide various combinations of the set of switches to bias the projectile 2 to at least one desired target 52 at a distance away from the POI 50.

Figure 6A:
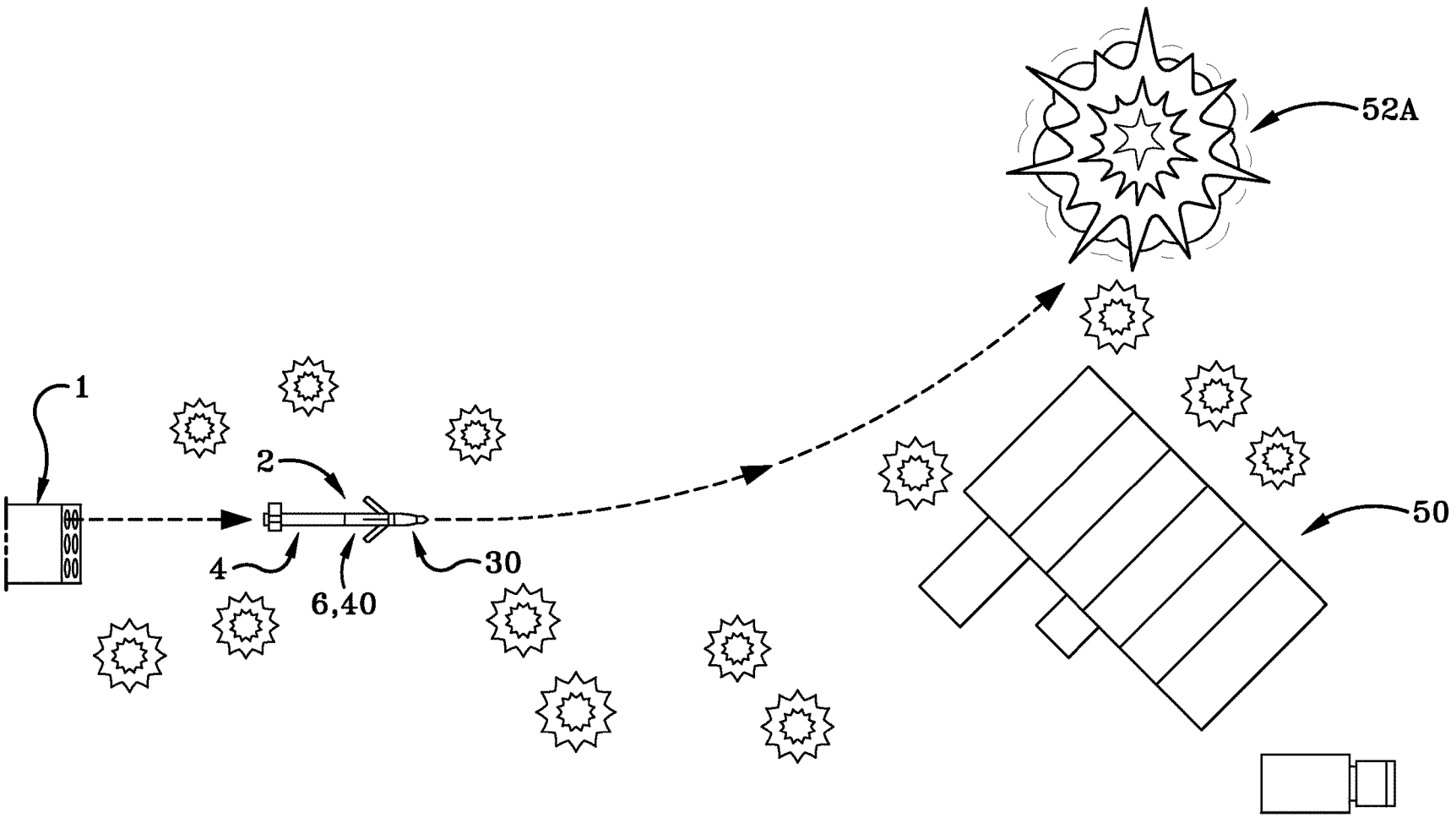
FIG. 6A is an operational view of launching the projectile proximate to a point of interest (POI), wherein the guidance protocol biases and/or guides the projectile to a first lateral location proximate to the POI for suppression.

In one instance, as illustrated in FIG. 6A, the operator may desire to bias the projectile 2 to a first lateral target 52A at a distance away from the POI 50. Prior to launching the projectile 2, the operator may select a predetermined position for one of the second, third, or fourth switches 20B, 20C, 20D to enable the projectile 2 to be biased to the first lateral target 52A relative to the POI 50 via commands sent from the processor 14 to the rocket motor 4 and the guidance kit 6. In the illustrated embodiment, the second switch 20B is logically mapped to the second angular offset mode 42B from the set of angular offset modes 42 to enable the projectile 2 to be biased to the first lateral target 52A relative to the POI 50 via commands sent from the processor 14 to the rocket motor 4 and the guidance kit 6. Additionally, the operator will be given or have knowledge of a first predetermined position to actuate the second switch 20B relative to the second indicator 8G2 on the body 8 to enable the projectile 2 to be biased to the first lateral target 52A relative to the POI 50 via commands sent from the processor 14 to the rocket motor 4 and the guidance kit 6.

In this embodiment, the first predetermined position to enable the projectile 2 to be biased laterally relative to the POI 50 via commands sent from the processor 14 to the rocket motor 4 and the guidance kit 6 will be an available numerical value labeled in the set of second codes 22B provided with the second switch 20B. Once the operator has knowledge of the second predetermined position, the operator will then turn the second switch 20B, either clockwise or counterclockwise, until the numerical valve labeled in the set of second codes 22B that enables the projectile 2 to be biased to the first lateral target 52A relative to the POI 50 via commands sent from the processor 14 to the rocket motor 4 and the guidance kit 6 aligns with the second indicator 8G2 on the body 8. Once aligned, the projectile 2 will be biased to the first lateral target 52A relative to the POI 50 via commands sent from the processor 14 to the rocket motor 4 and the guidance kit 6.

When the first and second switches 20A, 20B are set to the desired combination, the projectile 2 is set to be launched from the launch vehicle 1. Once launched, the projectile 2 will travel in a linear direction away from the launch vehicle 1 for a predetermined dwell time to determine the down acceleration direction relative to the projectile 2 (i.e., gravity asserted on the projectile 2) via the guidance protocol 40. Such determination of the down acceleration direction of the projectile 2 is determined by the accelerometer 16 and the gyroscope 18 provided with the guidance kit 6. In the illustrated embodiment, the guidance kit 6 is configured to determine the down acceleration direction at about five seconds subsequent to launching the projectile 2.

Upon determination of the down acceleration direction of the projectile 2, the processor 14 is enabled, via the guidance protocol 40, to bias the projectile 2 towards the first lateral target 52A that is a distance away from the POI 50. As described previously, the processor 14 sends commands to one or both of the rocket motor 4 and the set of retractable wings 10 of the guidance kit 6 to bias and/or guide the projectile 2 towards the first lateral target 52A. The processor 14 continues to send commands to one or both of the rocket motor 4 and the set of retractable wings 10 of the guidance kit 6 to bias and/or guide the projectile 2 towards the first lateral target 52A until the projectile 2 reaches the first lateral target 52A and/or once the payload 30 detonates.

Figure 6B:
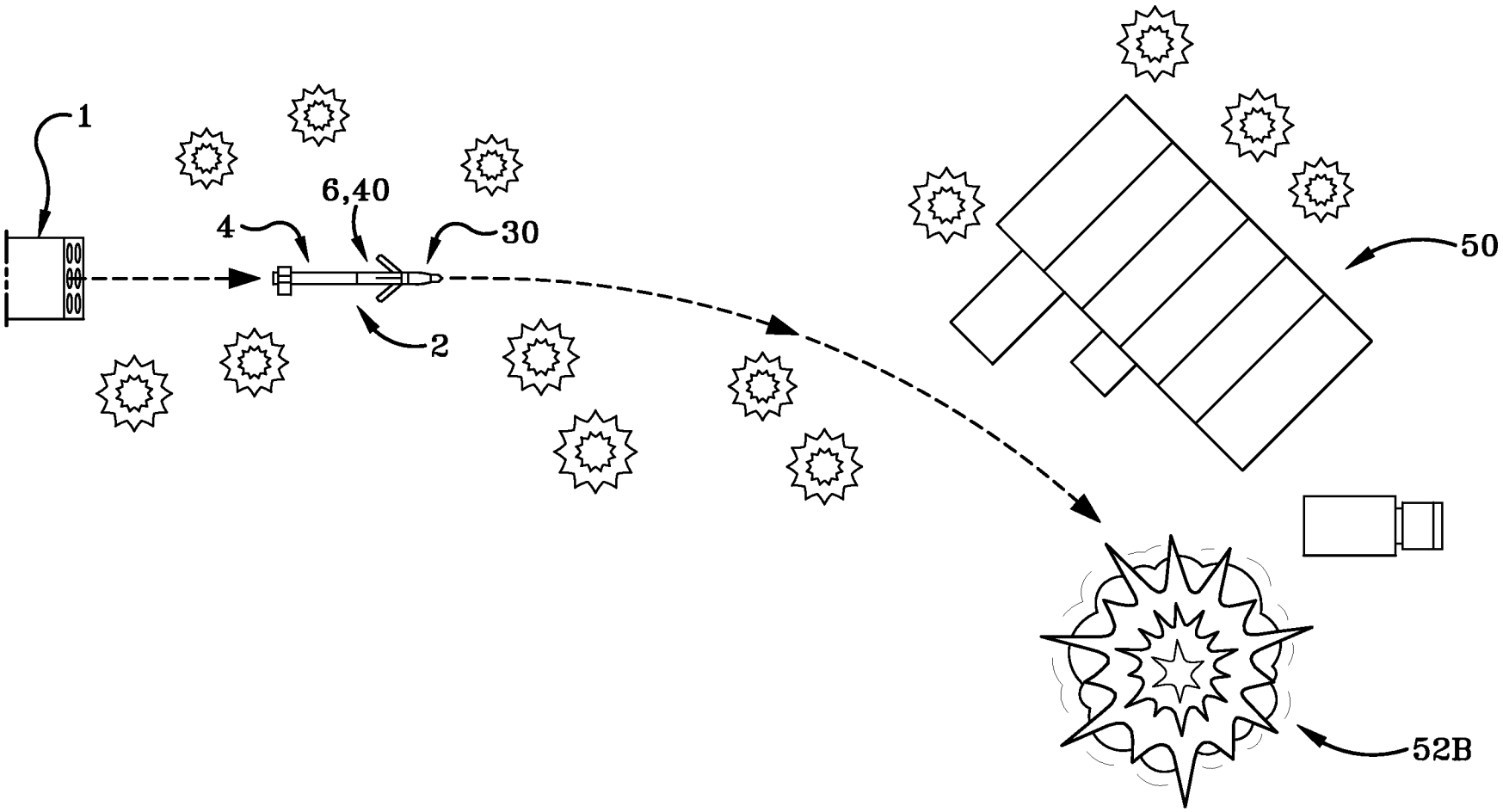
FIG. 6B is another operational view similar to FIG. 6A, but the guidance protocol biases and/or guides the projectile to a second lateral location proximate to the POI for suppression.

In another instance, as illustrated in FIG. 6B, the operator may desire to bias the projectile 2 to a second lateral target 52A at a distance away from the POI 50. As illustrated in FIGS. 6B, the second lateral target 52B opposes the first lateral target 52A relative to the POI 50. Prior to launching the projectile 2, the operator may select a predetermined position for one of the second, third, or fourth switches 20B, 20C, 20D to enable the projectile 2 to be biased to the second lateral target 52B relative to the POI 50 via commands sent from the processor 14 to the rocket motor 4 and the guidance kit 6. In the illustrated embodiment, the second switch 20B is logically mapped with the second angular offset mode 42B from the set of angular offset modes 42 to enable the projectile 2 to be biased to the second lateral target 52B relative to the POI 50 via commands sent from the processor 14 to the rocket motor 4 and the guidance kit 6. Additionally, the operator will be given or have knowledge of a second predetermined position to actuate the second switch 20B relative to the second indicator 8G2 on the body 8 to enable the projectile 2 to be biased to the second lateral target 52B relative to the POI 50 via commands sent from the processor 14 to the rocket motor 4 and the guidance kit 6.

In this embodiment, the second predetermined position to enable the projectile 2 to be biased to the second lateral target 52B relative to the POI 50 via commands sent from the processor 14 to the rocket motor 4 and the guidance kit 6 will be an available numerical value labeled in the set of second codes 22B provided with the second switch 20B. Once the operator has knowledge of the second predetermined position, the operator will then turn the second switch 20B, either clockwise or counterclockwise, until the numerical valve labeled in the set of second codes 22B that enables the projectile 2 to be biased to the second lateral target 52B relative to the POI 50 via commands sent from the processor 14 to the rocket motor 4 and the guidance kit 6 aligns with the second indicator 8G2 on the body 8. Once aligned, the projectile 2 will be biased to the second lateral target 52B relative to the POI 50 via commands sent from the processor 14 to the rocket motor 4 and the guidance kit 6.

Upon determination of the down acceleration direction of the projectile 2 by the accelerometer 16 and the gyroscope 18 (as described above), the processor 14 is enabled, via the guidance protocol 40, to bias the projectile 2 towards the second lateral target 52A that is a distance away from the POI 50. As described previously, the processor 14 sends commands to one or both of the rocket motor 4 and the set of retractable wings 10 of the guidance kit 6 to bias and/or guide the projectile 2 towards the second lateral target 52B. The processor 14 continues to send commands to one or both of the rocket motor 4 and the set of retractable wings 10 of the guidance kit 6 to bias and/or guide the projectile 2 towards the second lateral target 52B until the projectile 2 reaches the second lateral target 52B and/or once the payload 30 detonates.

Figure 6C:
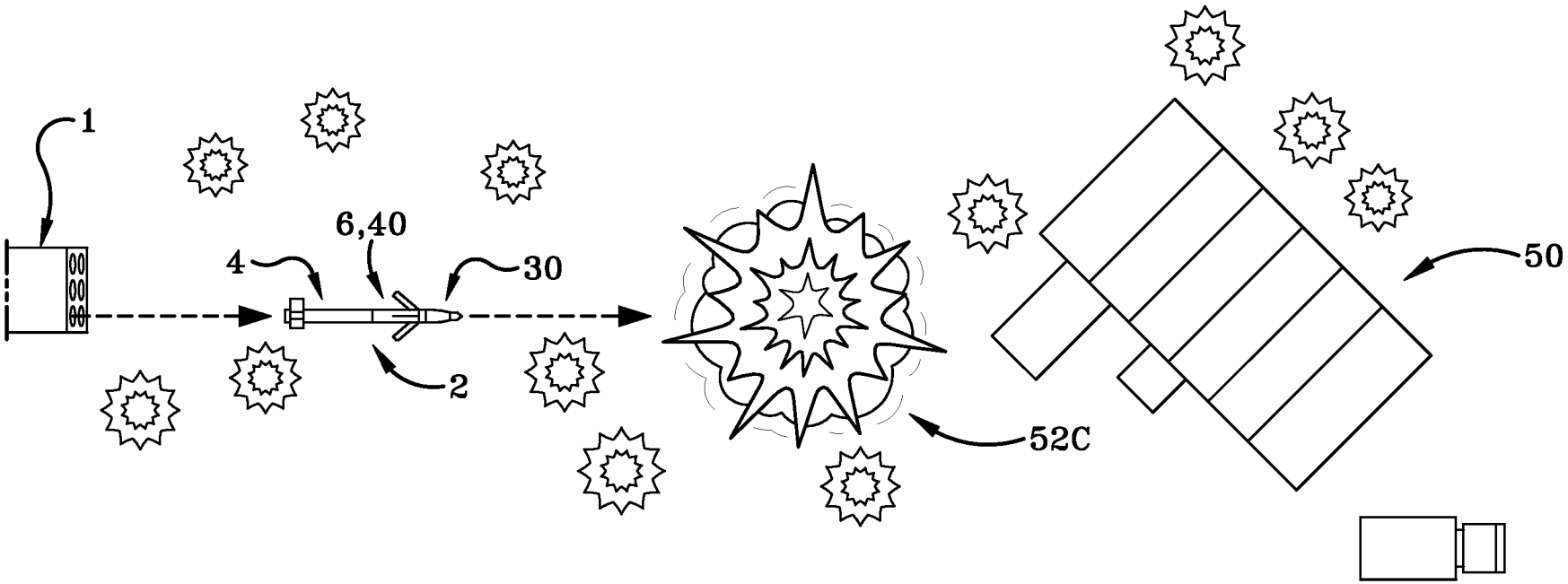
FIG. 6C is another operational view similar to FIG. 6A, but the guidance protocol biases and/or guides the projectile to a first longitudinal location proximate to the POI for suppression.

In yet another instance, as illustrated in FIG. 6C, the operator may desire to bias the projectile 2 to a first longitudinal target 52C at a distance away from the POI 50. Prior to launching the projectile 2, the operator may select a predetermined position for one of the third or fourth switches 20C, 20D to enable the projectile 2 to be biased to the first longitudinal target 52C relative to the POI 50 via commands sent from the processor 14 to the rocket motor 4 and the guidance kit 6. In the illustrated embodiment, the third switch 20C is logically mapped to the third angular offset mode 42C from the set of angular offset modes 42 to enable the projectile 2 to be biased to the first longitudinal target 52C relative to the POI 50 via commands sent from the processor 14 to the rocket motor 4 and the guidance kit 6. Additionally, the operator will be given or have knowledge of a first predetermined position to actuate the third switch 20B relative to the third indicator 8G3 on the body 8 to enable the projectile 2 to be biased to the first longitudinal target 52C relative to the POI 50 via commands sent from the processor 14 to the rocket motor 4 and the guidance kit 6.

In this embodiment, the first predetermined position to enable the projectile 2 to be biased to the first longitudinal target 52C relative to the POI 50 via commands sent from the processor 14 to the rocket motor 4 and the guidance kit 6 will be an available numerical value labeled in the set of third codes 22C provided with the third switch 20C. Once the operator has knowledge of the first predetermined position, the operator will then turn the third switch 20C, either clockwise or counterclockwise, until the numerical valve labeled in the set of third codes 22C that enables the projectile 2 to be biased to the first longitudinal target 52C relative to the POI 50 via commands sent from the processor 14 to the rocket motor 4 and the guidance kit 6 aligns with the third indicator 8G3 on the body 8. Once aligned, the projectile 2 will be biased to the first longitudinal target 52C relative to the POI 50 via commands sent from the processor 14 to the rocket motor 4 and the guidance kit 6.

Upon determination of the down acceleration direction of the projectile 2 by the accelerometer 16 and the gyroscope 18 (as described above), the processor 14 is enabled, via the guidance protocol 40, to bias the projectile 2 towards the first longitudinal target 52C that is a distance away from the POI 50. As described previously, the processor 14 sends commands to one or both of the rocket motor 4 and the set of retractable wings 10 of the guidance kit 6 to bias and/or guide the projectile 2 towards the first longitudinal target 52C. The processor 14 continues to send commands to one or both of the rocket motor 4 and the set of retractable wings 10 of the guidance kit 6 to bias and/or guide the projectile 2 towards the first longitudinal target 52C until the projectile 2 reaches the first longitudinal target 52C and/or once the payload 30 detonates.

Figure 6D:
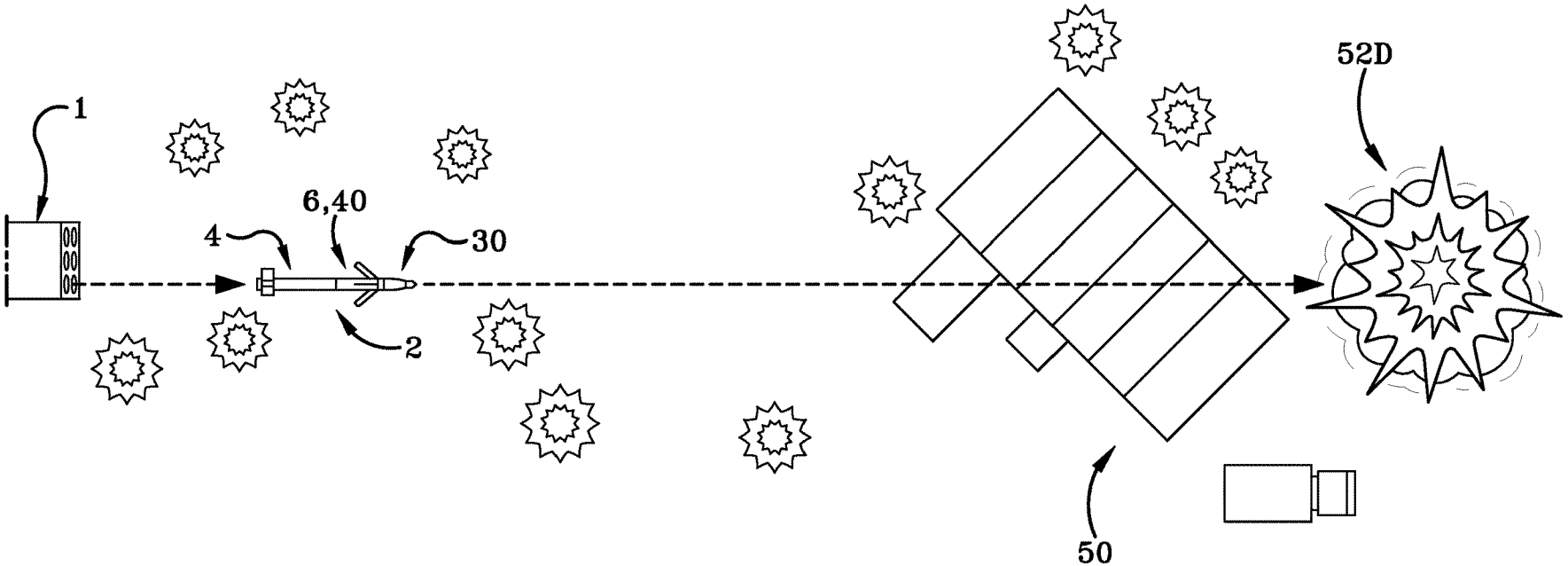
FIG. 6D is another operational view similar to FIG. 6A, but the guidance protocol biases and/or guides the projectile to a second longitudinal location proximate to the POI for suppression.

In yet another instance, as illustrated in FIG. 6D, the operator may desire to bias the projectile 2 to a second longitudinal target 52D at a distance away from the POI 50; the second longitudinal target 52D is opposite to the first longitudinal target 52C relative to the POI 50. Prior to launching the projectile 2, the operator may select a predetermined position for one of the third or fourth switches 20C, 20D to enable the projectile 2 to be biased to the second longitudinal target 52D relative to the POI 50 via commands sent from the processor 14 to the rocket motor 4 and the guidance kit 6. In the illustrated embodiment, the third switch 20C is logically mapped to the third angular offset mode 42C from the set of angular offset modes 42 to enable the projectile 2 to be biased to the second longitudinal target 52D relative to the POI 50 via commands sent from the processor 14 to the rocket motor 4 and the guidance kit 6. Additionally, the operator will be given or have knowledge of a second predetermined position to actuate the third switch 20C relative to the third indicator 8G3 on the body 8 to enable the projectile 2 to be biased to the second longitudinal target 52D relative to the POI 50 via commands sent from the processor 14 to the rocket motor 4 and the guidance kit 6.

In this embodiment, the second predetermined position to enable the projectile 2 to be biased to the second longitudinal target 52D relative to the POI 50 via commands sent from the processor 14 to the rocket motor 4 and the guidance kit 6 will be an available numerical value labeled in the set of third codes 22C provided with the third switch 20C. Once the operator has knowledge of the second predetermined position, the operator will then turn the third switch 20C, either clockwise or counterclockwise, until the numerical valve labeled in the set of third codes 22C that enables the projectile 2 to be biased to the second longitudinal target 52D relative to the POI 50 via commands sent from the processor 14 to the rocket motor 4 and the guidance kit 6 aligns with the third indicator 8G3 on the body 8. Once aligned, the projectile 2 will be biased to the second longitudinal target 52D relative to the POI 50 via commands sent from the processor 14 to the rocket motor 4 and the guidance kit 6.

Upon determination of the down acceleration direction of the projectile 2 by the accelerometer 16 and the gyroscope 18 (as described above), the processor 14 is enabled, via the guidance protocol 40, to bias the projectile 2 towards the second longitudinal target 52D that is a distance away from the POI 50. As described previously, the processor 14 sends commands to one or both of the rocket motor 4 and the set of retractable wings 10 of the guidance kit 6 to bias and/or guide the projectile 2 towards the second longitudinal target 52D. The processor 14 continues to send commands to one or both of the rocket motor 4 and the set of retractable wings 10 of the guidance kit 6 to bias and/or guide the projectile 2 towards the second longitudinal target 52D until the projectile 2 reaches the second longitudinal target 52D and/or once the payload 30 detonates.

While not illustrated herein, an operator may set and/or be instructed to set a desired combination of the switches 20B, 20C, 20D for laterally and longitudinally biasing at least one projectile 2 to a desired target at a distance away from the POI 50. In one example, an operator may set a first combination for the switches 20B, 20C, 20D of at least one projectile 2 where the at least one projectile 2 is biased towards a left or first lateral position relative to the POI 50 and biased in a first longitudinal position relative to the POI 50. In another example, an operator may set a second combination for the switches 20B, 20C, 20D of at least one projectile 2 where the at least one projectile 2 is biased in a left or first lateral position relative to the POI 50 and biased towards a second longitudinal position relative to the POI 50; in this example, the at least one projectile 2 has a greater flight time to reach the second longitudinal position in comparison to the flight time of the first longitudinal position in the previous example. In yet another example, an operator may set a third combination for the switches 20B, 20C, 20D of at least one projectile 2 where the at least one projectile 2 is biased in a right or second lateral position relative to the POI 50 and biased towards a first longitudinal position relative to the POI 50; in this example, the second lateral position is opposite to the first lateral position in the previous examples. In yet another example, an operator may set a fourth combination for the switches 20B, 20C, 20D of at least one projectile 2 where the at least one projectile 2 is biased in a right or second lateral position relative to the POI 50 and biased towards a second longitudinal position relative to the POI 50; in this example, the second lateral position is opposite to the first lateral position in the previous examples; in this example, the at least one projectile 2 has a greater flight time to reach the second longitudinal position in comparison to the flight time of the first longitudinal position in the previous examples.

While not illustrated herein, the launch vehicle 1 may also be positioned in a direction facing away from the POI 50 as compared to the launch vehicle 1 being positioned in a direction facing towards and/or at the POI 50 in FIGS. 1 and 6A-6D. In this situation, an operator of the projectile 2 may set at least one of the second, third, and fourth switches 20B, 20C, 20D to a predetermined position to bias the projectile 2 towards a target that is positioned at a distance away from the POI 50. In one instance, the operator may set the second switch 20B at a first predetermined position to bias projectile 2 in a left or a first lateral direction relative to the launch vehicle 1 subsequent to being launched. In another instance, the operator may set the second switch 20B at a second predetermined position to bias projectile 2 in a right or a second lateral direction relative to the launch vehicle 1 subsequent to being launched.

While not illustrated herein, at least one projectile (such as projectile 2) may be biased to a first targeted position relative to the POI 50 and at least another projectile (such as projectile 2) may be biased to a second targeted position relative to the POI 50. In one example, a first projectile may be biased to a first targeted position relative to the POI 50 and a second projectile (such as projectile 2) may be biased to a second targeted position relative to the POI 50; the first targeted position and the second targeted position are different and are set at distances away from the POI 50. In another example, a first set of projectiles may be biased to a first targeted position relative to the POI 50 and a second set of projectiles (such as projectile 2) may be biased to a second targeted position relative to the POI 50; the first targeted position and the second targeted position are different and are set at distances away from the POI 50.

While not illustrated herein, the operator may desire to actuate and/or use the fourth angular offset mode 42D of the set of angular offset modes 42 to enable auxiliary capabilities and/or features that enhance or deter features of the guidance protocol 40. In this instance, the fourth switch 20D may be logically mapped or logically assigned with the fourth angular offset mode 42D from the set of angular offset modes 42 to enable the projectile 2 to enable auxiliary capabilities and/or features that enhance or deter features of the guidance protocol 40. Additionally, the operator will be given or have knowledge of at least one predetermined position to actuate the fourth switch 20D relative to the fourth indicator 8G4 on the body 8 to enable auxiliary capabilities and/or features that enhance or deter features of the guidance protocol 40. In one exemplary embodiment, an operator may provide the fourth switch in a first predetermined positioned aligned with the fourth indicator 8G1 to enable use of the optic devices 12 provided with the guidance kit 6; in this exemplary embodiment, the fourth angular offset mode 42D may override the guidance function provided by the accelerometer 14 and the gyroscope 16 and follow an external guidance source (e.g., a laser).

Such biasing of at least one projectile via the guidance protocol 40, as described and illustrated herein, is considered advantageous at least because targeting areas and/or locations surrounding the POI 50 may cause confusion and misperception to the POI 50 since no external guiding source is used with the projectile 2. Additionally, biasing the projectile 2, via the guidance protocol 40, may target randomized areas and/or locations surrounding the POI 50 to create confusion and misperception to the POI 50 since no external guiding source is used with the projectile 2.

Figure 7:
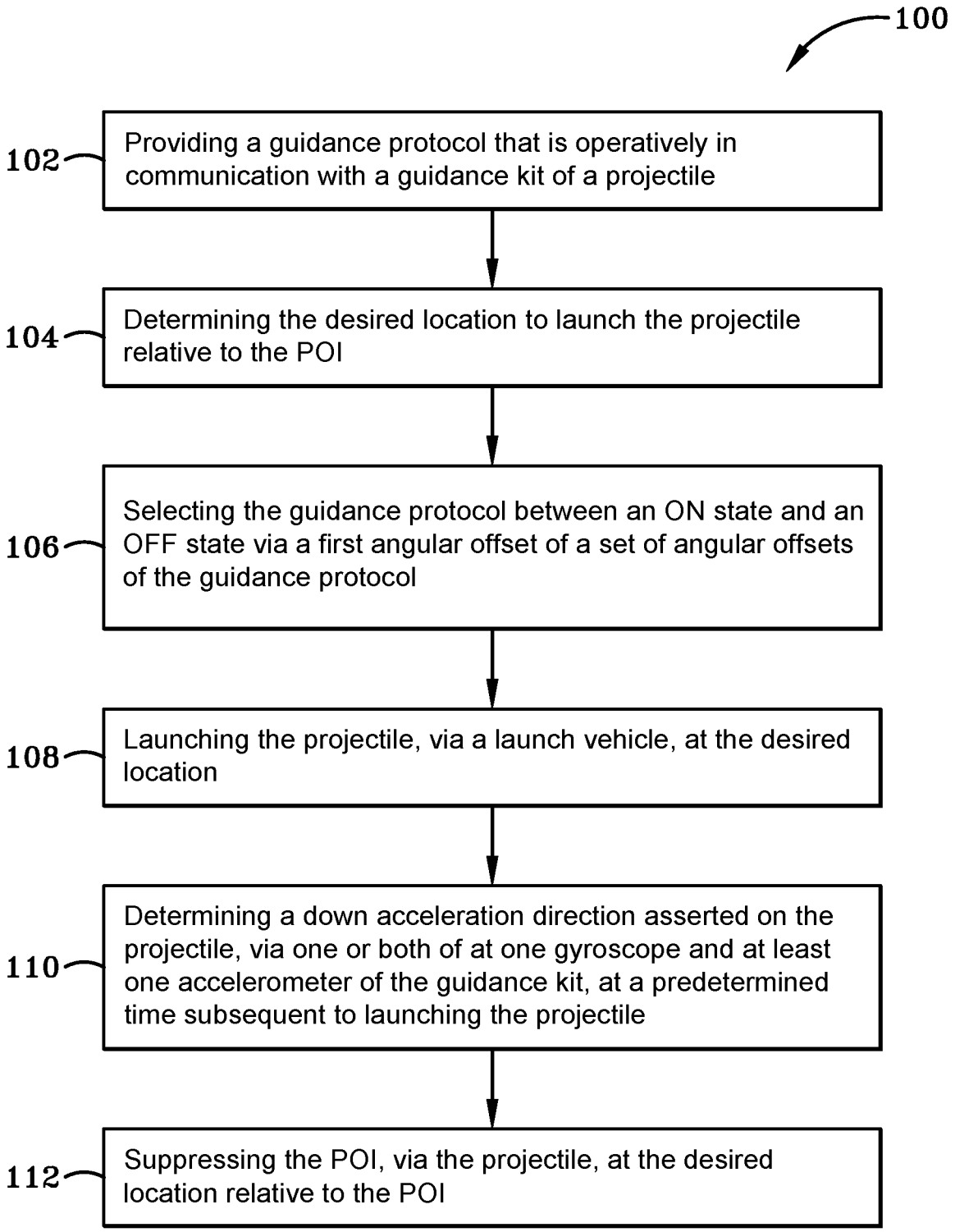
FIG. 7 is a method flowchart of suppressing a POI at a desired location relative to the POI.

FIG. 7 illustrates a method 100 of suppressing a point-of-interest (POI) at a desired location relative to the POI. An initial step 102 of method 100 comprises providing a guidance protocol that is operatively in communication with a guidance kit of a projectile. Another step 104 of method 100 comprises determining the desired location to launch the projectile relative to the POI. Another step 106 of method 100 comprises selecting the guidance protocol between an ON state and an OFF state via a first angular offset of a set of angular offsets of the guidance protocol. Another step 108 of method 100 comprises launching the projectile, via a launch vehicle, at the desired location. Another step 110 of method 100 comprises determining a down acceleration direction asserted on the projectile, via one or both of at least one gyroscope and at least one accelerometer of the guidance kit, at a predetermined time subsequent to launching the projectile. Another step 112 of method 100 comprises suppressing the POI, via the projectile, at the desired location relative to the POI.

In other exemplary embodiments, method 100 may include additional or optional steps. An optional step may include activating the guidance protocol to the ON state via at least one code of a set of first codes of the guidance kit. An optional step may include deactivating the guidance protocol to the OFF state via at least another code of the set of first codes of the guidance kit. An optional step may include selecting the guidance protocol to bias the projectile, via a second angular offset of the set of angular offsets of the guidance protocol, between a first lateral position relative to the POI and a second lateral position relative to the POI; wherein the first lateral position and the second lateral position are opposite to one another relative to the POI. An optional step may include biasing the projectile, via at least one range of codes of a set of second codes designating the second angular offset mode, to the first lateral position relative to the POI. An optional step may include biasing the projectile, via at least another range of codes of the set of second codes designating the second angular offset mode, to the second lateral position relative to the POI. An optional step may include selecting the guidance protocol to bias the projectile, via a third angular offset of the set of angular offsets of the guidance protocol, between a first longitudinal position relative to the POI and a second longitudinal position relative to the POI; wherein the first longitudinal position and the second longitudinal position are opposite to one another relative to the POI. An optional step may include biasing the projectile, via at least one range of codes of a set of third codes designating the third angular offset mode, to the first longitudinal position relative to the POI. An optional step may include biasing the projectile, via at least another range of codes of the set of third codes designating the second angular offset mode, to the second longitudinal position relative to the POI.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A guidance kit for a projectile, comprising:

at least one processor in the guidance kit;

a guidance protocol operatively in communication with the guidance kit and the at least one processor and having a set of angular offset modes;

at least one gyroscope operatively connected with the at least one processor;

at least one accelerometer operatively connected with the at least one processor;

a set of first codes provided with the guidance kit; and a first angular offset mode of the set of angular offset modes operatively in communication with the set of first codes;

wherein the guidance protocol is configured to guide the projectile to at least one location relative to a desired point-of-interest (POI) upon or in response to activation of at least one angular offset mode of the set of angular offset modes;

wherein the at least one gyroscope and the at least one accelerometer are configured to determine a down acceleration direction of the projectile at a predetermined time subsequent to launching the projectile from a launch vehicle; and wherein the first angular offset mode is configured to activate the guidance protocol between an ON state and an OFF state.

2. The guidance kit of claim 1, further comprising:

at least one code of the set of first codes designates the first angular offset mode to activate the guidance protocol to the ON state.

3. The guidance kit of claim 2, further comprising:

at least another code of the set of first codes designates the first angular offset mode to deactivate the guidance protocol to the OFF state.

4. The guidance kit of claim 1, further comprising:

a set of second codes provided with the guidance kit; and a second angular offset mode the set of angular offset modes operatively in communication with the set of second codes;

wherein the second angular offset mode is configured to bias the projectile between a first lateral position relative to the POI and a second lateral position relative to the POI; and wherein the first lateral position and the second lateral position are opposite to one another relative to the POI.

5. The guidance kit of claim 4, further comprising:

at least one range of codes of the set of second codes designates the second angular offset mode to bias the projectile to the first lateral position relative to the POI.

6. The guidance kit of claim 5, further comprising:

at least another range of codes of the set of second codes designates the second angular offset mode to bias the projectile to the second lateral position relative to the POI.

7. The guidance kit of claim 4, further comprising:

a set of third codes provided with the guidance kit; and a third angular offset mode the set of angular offset modes operatively in communication with the set of second codes;

wherein the third angular offset mode is configured to bias the projectile between a first longitudinal position relative to the POI and a second longitudinal position relative to the POI; and wherein the first longitudinal position and the second longitudinal position are opposite to one another relative to the POI.

8. The guidance kit of claim 7, further comprising:

at least one range of codes of the set of third codes designates the third angular offset mode to bias the projectile to the first longitudinal position relative to the POI.

9. The guidance kit of claim 8, further comprising:

at least another range of codes of the set of second codes designates the third angular offset mode to bias the projectile to the second longitudinal position relative to the POI.

* * * * *